US006051068A

United States Patent [19]

Kohl et al.

[11] Patent Number: 6,051,068

[45] Date of Patent: Apr. 18, 2000

[54] SYSTEM FOR SELECTIVE TREATMENT OF A TRAVELING PAPER WEB

[75] Inventors: Bernhard Kohl; Stefan Reich; Wilfried Kraft, all of Heidenheim, Germany

[73] Assignee: Voith Sulzer Papiermaschinen GmbH, Heidenheim, Germany

[21] Appl. No.: 08/960,554

[22] Filed: Oct. 31, 1997

Related U.S. Application Data

[63] Continuation of application No. 08/848,703, Apr. 18, 1997, abandoned, which is a continuation of application No. 08/474,717, Jun. 7, 1995, abandoned.

[30] Foreign Application Priority Data

Jun. 10, 1994 [DE] Germany ..... 44 20 242

[51] Int. Cl.[7] ..... B05C 1/00

[52] U.S. Cl. ..... 118/641; 118/642; 118/643; 118/58; 118/60; 118/62; 118/67; 118/68; 118/219; 118/224; 118/249; 118/262

[58] Field of Search ..... 118/641–643, 58, 118/60, 62, 67, 68, 219, 223, 224, 249, 261, 262; 34/621, 623; 162/135, 136, 206, 265

[56] References Cited

U.S. PATENT DOCUMENTS

| | | | |
|---|---|---|---|
| 2,093,347 | 9/1937 | Beecher | 91/50 |
| 2,186,874 | 1/1940 | Mason | 92/40 |
| 2,281,340 | 4/1942 | Thiele et al. | 162/265 |
| 3,895,603 | 7/1975 | Barouh et al. | 118/67 |
| 3,908,071 | 9/1975 | Heim et al. | 428/537 |
| 3,993,805 | 11/1976 | Roberts | 118/223 |
| 5,163,236 | 11/1992 | Heikkila | 34/115 |
| 5,163,365 | 11/1992 | Taylor | 162/206 |
| 5,310,573 | 5/1994 | Tanokuchi et al. | 118/249 |
| 5,401,314 | 3/1995 | Kustermann | 118/258 |
| 5,447,566 | 9/1995 | Loiacono | 118/249 |
| 5,469,636 | 11/1995 | Plomer | 162/135 |

FOREIGN PATENT DOCUMENTS

| | | | |
|---|---|---|---|
| 2177073 | 11/1995 | Canada . | |
| 0417368A1 | 9/1989 | European Pat. Off. . | |
| 0 596 365 A1 | 5/1994 | European Pat. Off. . | |
| 0 743 996 B1 | 5/1995 | European Pat. Off. . | |
| 9100291 | 5/1991 | Germany . | |
| 43 02 435 A1 | 8/1993 | Germany . | |
| 4302437A1 | 8/1993 | Germany . | |
| 4313628 | 9/1993 | Germany . | |
| 4328554 | 3/1994 | Germany . | |
| 873682 | 7/1961 | United Kingdom | 162/135 |

OTHER PUBLICATIONS

"The Speedsizer and its Application" by A. Plomer, Aug. 1989.

*Primary Examiner*—Laura Edwards
*Attorney, Agent, or Firm*—Baker & Daniels

[57] ABSTRACT

A system for selective treatment of a traveling web, preferably of paper or cardboard, by surface treatment or impregnation in which at least one coater is in the case of web treatment arranged after a dryer group for treatment of the one side of web. At least one further coater for treatment of the other side of the web is arranged before a further dryer group. Noncontact web deflectors are arranged after the coaters and noncontact dryers can be installed retroactively in existing dryer sections.

14 Claims, 6 Drawing Sheets

SYSTEM FOR SELECTIVE TREATMENT OF A TRAVELING PAPER WEB

This is a continuation of application Ser. No. 08/848,703, filed Apr. 18, 1997 now abandoned, which is a continuation of application Ser. No. 08/474,717, filed Jun. 7, 1995 now abandoned.

BACKGROUND OF THE INVENTION

1. Field of the Invention

The invention concerns a system for selective treatment of a traveling paper web by coating or impregnating in in-line arrangements.

2. Description of the Related Art

Voith Product Brochure No. "p 2771" discloses a so-called "Speedsizer" wherein the coating mixture is applied on both sides of the web simultaneously (FIGS. 2 through 8) In all of these illustrated embodiments, the web sections (paper trains) still are relatively long. This is evident especially in FIG. 8, which shows the retroactive installation of a coater for double-sided application of the coating mixture in an existing paper machine. The coater is followed by noncontact dryers arranged on both sides of the web, which necessitates an overall arrangement extending all the way into the basement. In addition to long paper trains, this variant entails disadvantages also in view of the necessary construction measures and tending options.

DE 43 13 628, which corresponds to co-pending U.S. patent application Ser. No. 08/229,173, now U.S. Pat. No. 5,469,636 involves long web sections and coaters and noncontact dryers that extend upwardly. The same disadvantages are present as in the aforementioned Voith Product Brochure.

Therefore, the problem underlying the invention is to provide a system where the surface treatment with a coating liquid, or impregnating, of a traveling paper web, can be performed with little expense, where the coaters required for existing dryer sections of a paper machine while nonetheless requiring only limited overall space, limited overall length, providing good tending options from the paper machine floor, and involving maximally short paper trains for the drying process. Additionally, the short unsupported paper trains are meant to enable a high runability, notably with high speeds and low web strengths.

This problem is solved by providing first and second dryer groups as well as first and second coaters to coat opposite sides of the web wherein the first coater is positioned after the first dryer group and the second coater is positioned before the second dryer group. Web deflectors follow the coaters.

According to the invention it is easily possible to retrofit an existing conventional dryer section with coaters and noncontact dryers for surface treatment of the traveling paper or cardboard web. It is possible as well to make use of the invention in the construction of a new paper machine.

The dryer section may be one as described, e.g., in DE 4 328 554 and consist of single-row dryer groups each with a single endless felt. Following the last single-felt dryer group is at least one dual-felt dryer group with several lower cylinders and several upper cylinders and with one upper felt and one lower felt. The dryer groups may be configured, if desired, in three rows or set obliquely, in so-called V-form.

The first coater to be installed is arranged preferably behind a double-row group of drying cylinders. The advantage of this is that the web can enter the first coater, if desired, with a final moisture content of, e.g., only 2%.

When a surface treatment or impregnation of the web is not desired, the solution according to the invention also enables at times the nonuse of the coaters integrated in the dryer section, where the path of the web may remain nearly unaltered. In such case, the afterdryer section may be utilized to increase the operating speed. This is possible because (without coating) less moisture must be removed from the web.

Overall, only a few drying cylinders, for example three, need to be removed, if coaters are installed into an existing dryer section.

The path of the paper web need not depart at any point from the normal space of the dryer section, so that the coaters can always be tended approximately from the paper machine floor.

The advantages resulting from a limited overall length, limited overall space requirements and very short unsupported paper trains are achieved by the arrangement of the coaters according to the invention, which at separate points treat once the underside and once the top side of the web, and by the arrangement of the following web deflection means, for example deflection rolls or noncontact deflection devices, which operate with unheated or heated air and are known as "air turn" or "air can" deflectors. Noncontact dryers are favorably coordinated with a drying cylinder fashioned as a deflection roll, i.e., the cylinder is preferably unheated. In the prior art, the noncontact dryers were arranged on both sides along the web path and, therefore, caused long paper trains.

Short unsupported paper trains also allow increased speeds of web travel, without inviting web breaks. In addition, the short unsupported paper trains allow with dry substance contents of the web $\leqq 80\%$ idle passage of the application area, when the applicators are not being used.

The invention will be explained hereafter with the aid of pictorially illustrated embodiments.

BRIEF DESCRIPTION OF THE DRAWINGS

The above-mentioned and other features and advantages of this invention, and the manner of attaining them, will become more apparent and the invention will be better understood by reference to the following description of several embodiments of the invention taken in conjunction with the accompanying drawings, wherein.

Identical components are referenced identically in the figures, which in the individual figure descriptions will not be addressed in any detail.

DETAILED DESCRIPTION OF THE INVENTION

Figure 1:
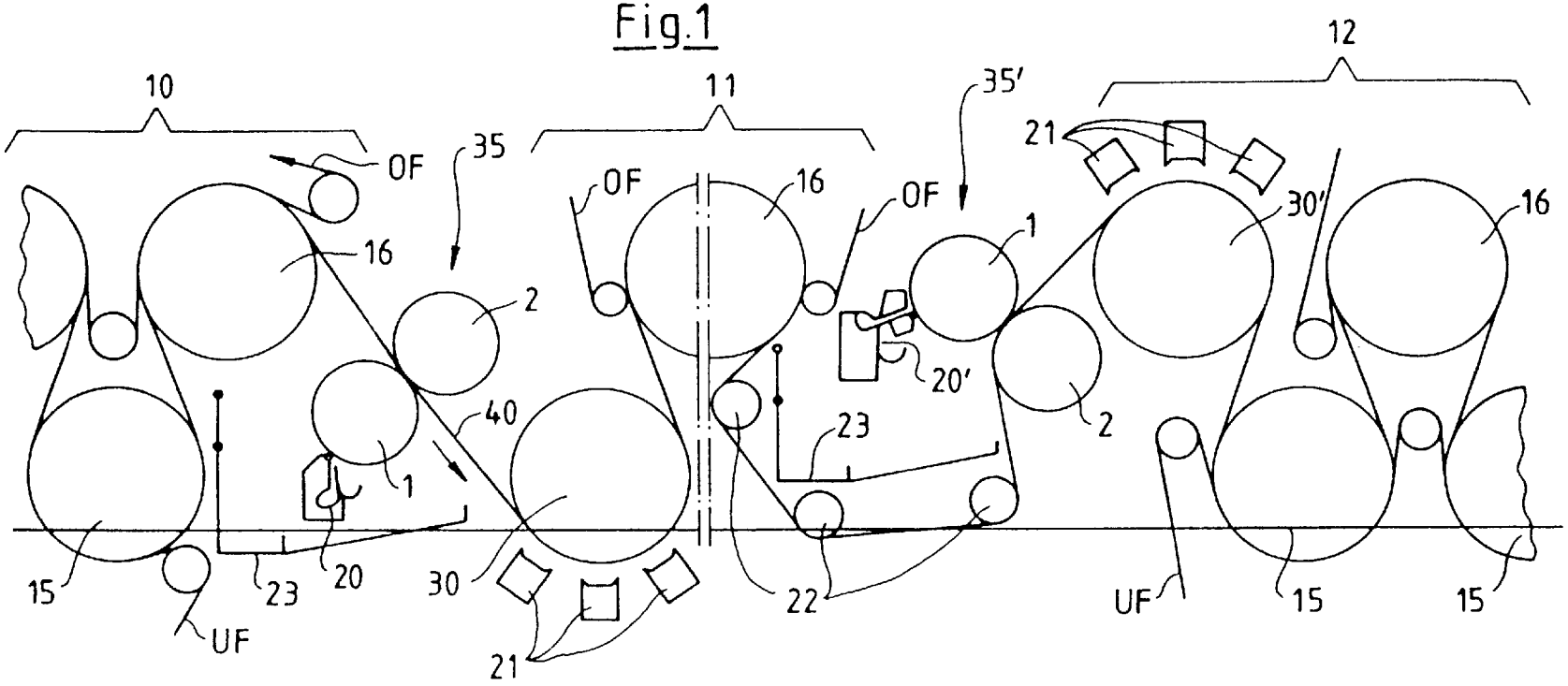
FIGS. 1 through 7 are diagrammatic side elevations of various embodiments of dryer sections consisting of several dryer groups and including coaters for treating the paper or cardboard web.

FIG. 1 shows three successively arranged double-row dryer groups 10, 11, 12—so-called double-felt dryer groups—each consisting of lower cylinders 15 with a usual lower felt UF (felt or dryer wire coverings) and upper cylinders 16 with upper felts OF. In other words, FIG. 1 shows a first dryer group 10, a second dryer group 12 and an intermediate dryer group 11. Dryer group 11 may comprise one upper cylinder 16 only; or at least two upper cylinders 16 and at least one lower cylinder which is not shown. Not illustrated are the drives, since they are of the conventional type.

A first coater 35 for treating one side (e.g., underside) of the web 40 is arranged after the first dryer group 10, from which web 40 departs obliquely downward. The coater 35 for one-sided application of a liquid coating mixture is coordinated here with a pair of rolls 1 and 2 forming a press gap. Roll 1 is the applicator roll, which is acted upon by a nozzle applicator 20, while roll 2 is the backing roll.

Coater 35 is followed by a rotating deflection roll 30 wrapped by web 40 and situated at the level of the lower drying cylinders 15 of first and second dryer groups 10 and 12. Roll 30 may be heated or unheated, may rotate or be stationary. If coater 35 has been mounted into an existing dryer section, roll 30 was previously a heatable drying cylinder.

As is evident from FIG. 1, the coated side of web 40 is dried, by means of a noncontact dryer system 21 arranged at the periphery of roll 30, to a degree such that thereafter it can be dried further by contact with another upper dryer 16 of dryer group 11. If required, an expander drum may be arranged before or after deflection roll 30.

Web 40 proceeds then across paper guide rolls 22, and from there in an upward direction to the next coater 35' for treatment of its other side, for instance the top side. The web passes in the process between a pair of rolls comprising rolls 1 and 2 and forming a press gap. Coater 35' preferably includes a specific nozzle applicator 20' according to German Patent Application No. P 44 13 232.8. A further noncontact dryer system 21', on the roll 30', follows coater 35'.

Figure 2:
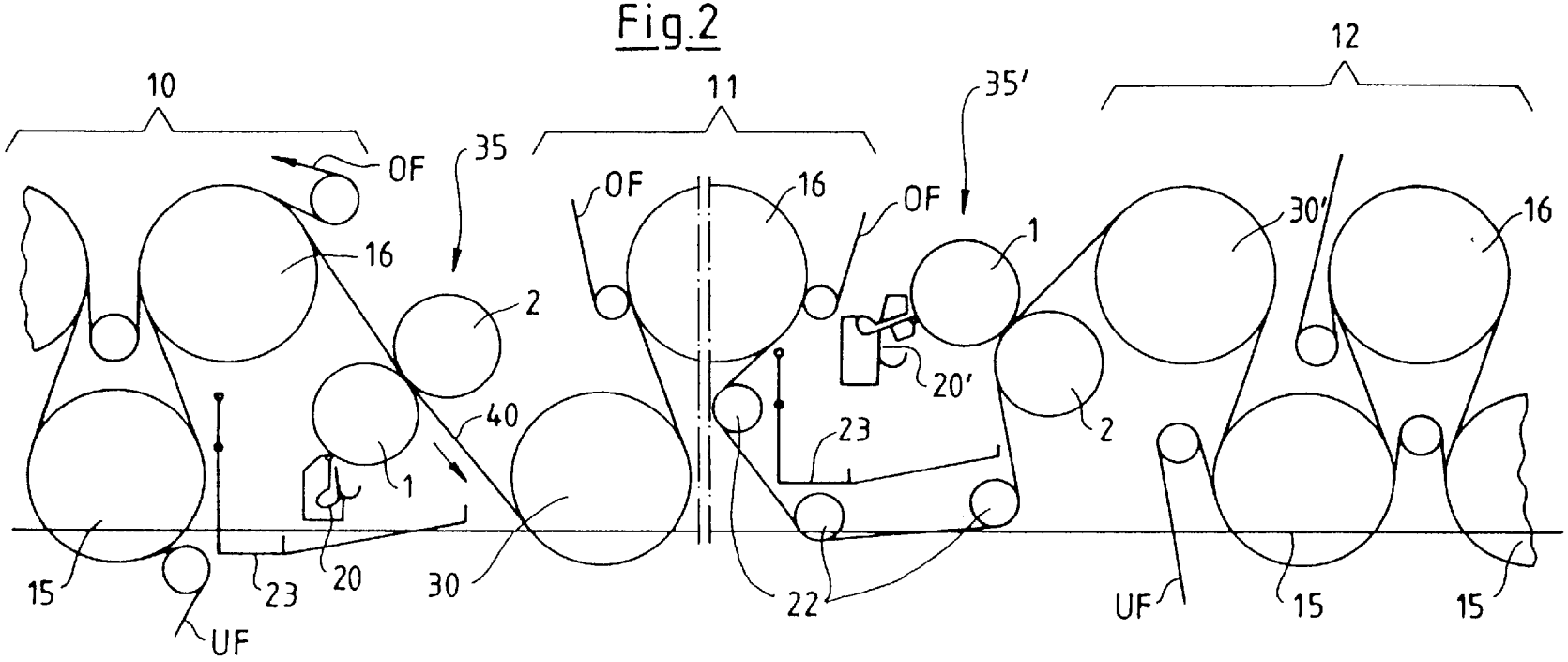

As shown in FIG. 2, it is possible also to use deflection rolls 30, 30' without noncontact dryers 21.

Figure 3:
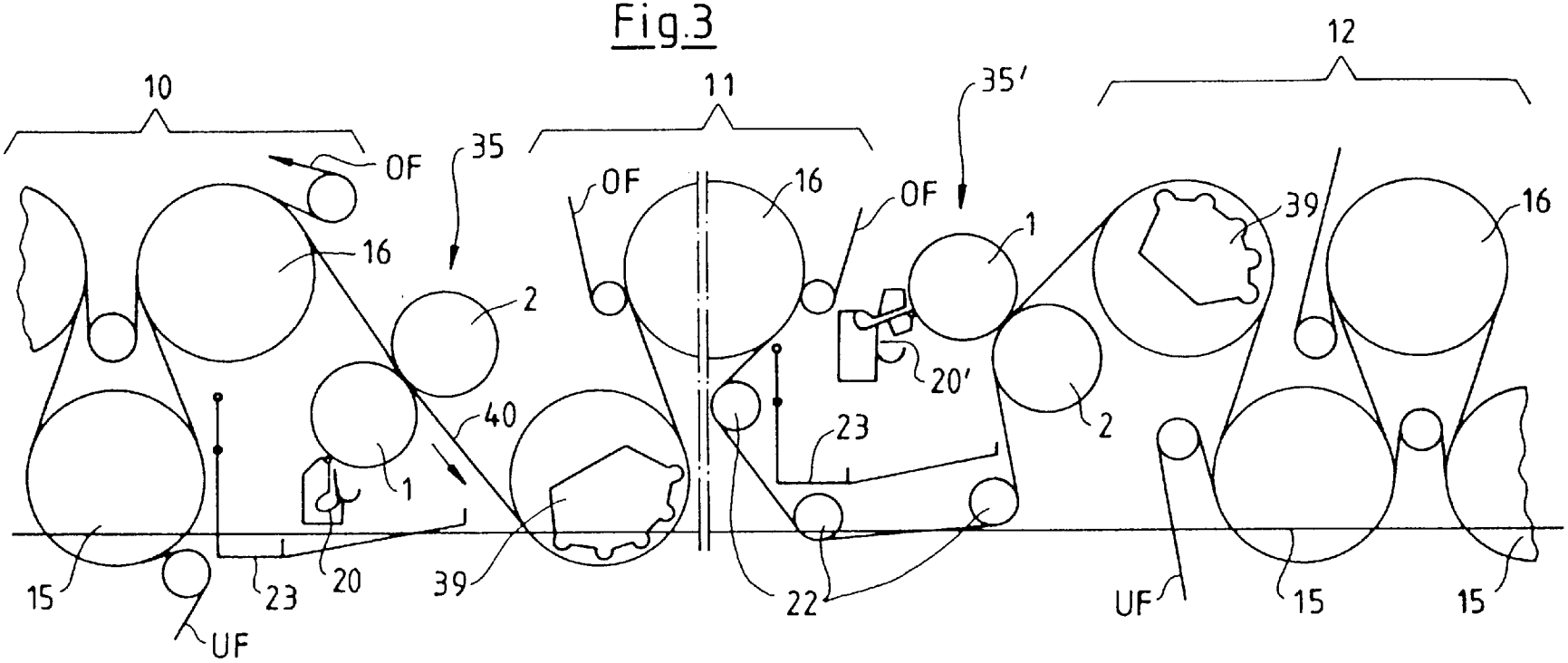
Figure 4:
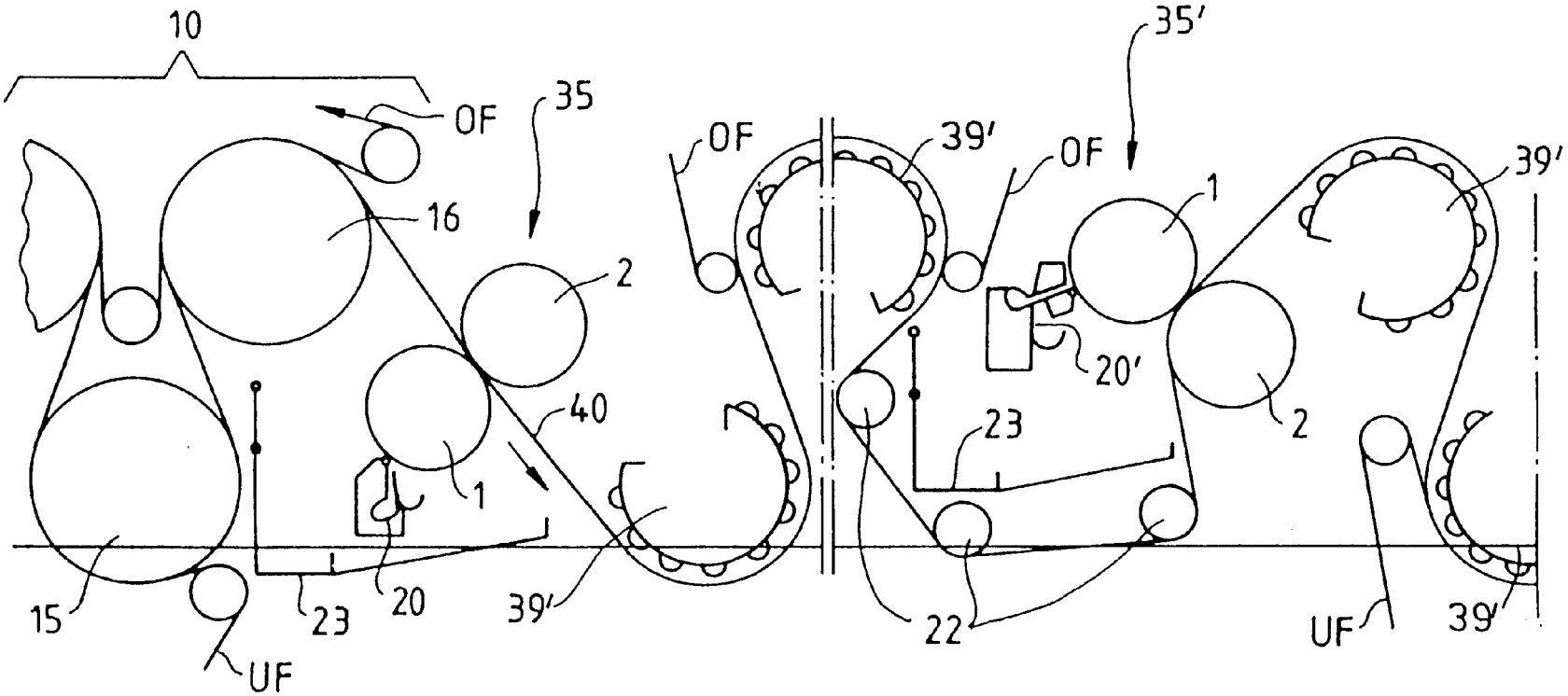

Illustrated in FIGS. 3 and 4 is the use of noncontact deflection means, in lieu of deflection rolls 30 and 30', with FIG. 3 showing the "air turn" 39 and FIG. 4 the "air can" 39'. The air turns 39 and air cans 39' are equipped with air nozzles for heated and unheated air, which create an air cushion for web deflection. An air turn issues normally cold air and serves to deflect the web. Operating with heated air, an air can represents at the same time a web deflector and web dryer.

As can be seen from FIGS. 1 through 3, further drying of the web 40 may take place in the usual manner in the next or second dryer group 12. Behind that, further coaters may be provided as well.

Similarly to roll 30, deflection roll 30' may be heated or unheated. In the latter case it represents a plain paper guide roll. Roll 30' may rotate or be stationary, the same as roll 30.

FIGS. 1 through 4 show additionally, below the coaters 35, 35', catwalks 23 provided with a railing and a collection tub for liquid coating mixture splashes.

Figure 5:
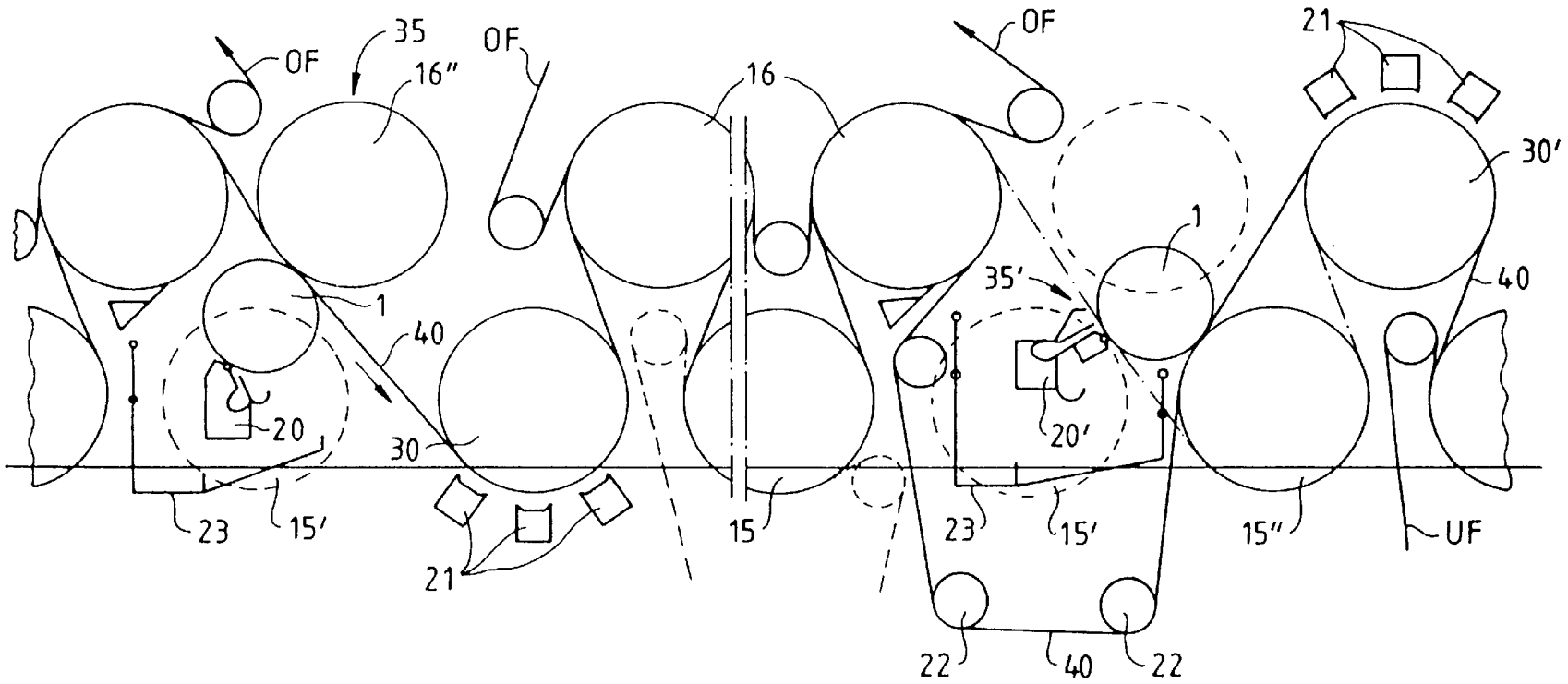

FIG. 5 illustrates the retroactive installation of coaters 35, 35' in an existing double-row dryer section. The drying cylinders and guide rolls, which for installation of the coaters 35, 35' had to be removed, are shown in the drawing by broken line. The drive needs to be rearranged in such a way that existing cylinders 15" and 16" cylinder can run opposite to the original direction of rotation and will allow separate speed control.

The removed drying cylinders 15' have been substituted again by applicator rolls 1 for the coaters 35 and 35' to be installed. Referenced 16" in FIG. 5 (at coater 35) and 15" (at coater 35'), an existing drying cylinder each serves as a backing roll. FIG. 5 also shows, by dashed line, the path of web 40—with the coater 35' unused—when the web is not meant to be routed across paper guide rolls 22.

Figure 6:
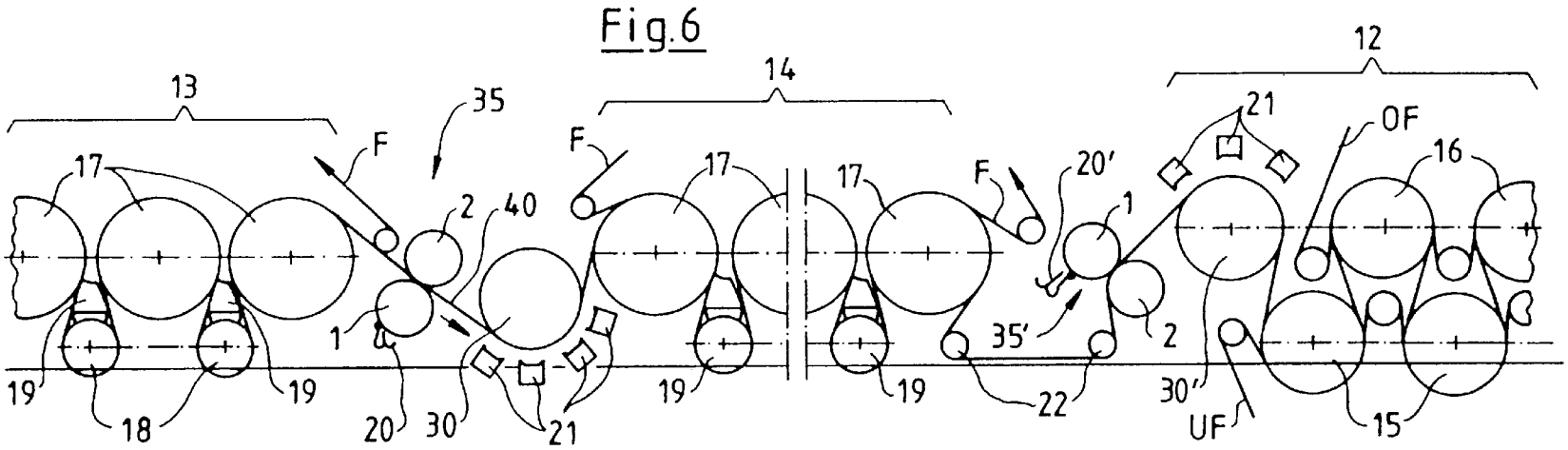
Figure 7:
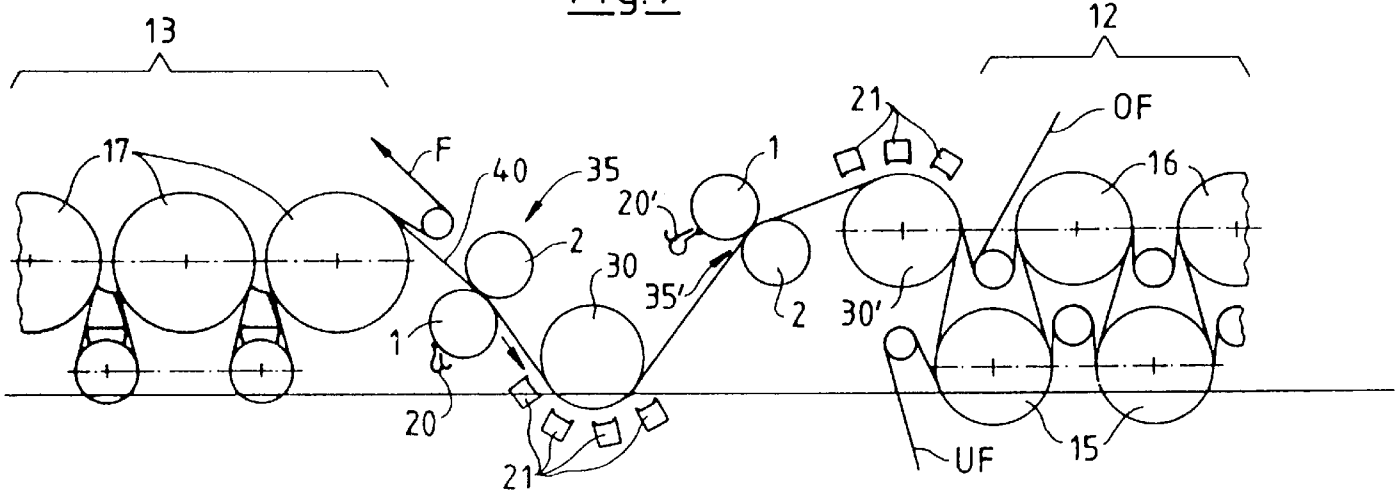

Two further variants of web threading are illustrated in FIGS. 6 and 7, showing that the first coater 35 may follow a single-row dryer group 13 consisting of drying cylinders 17. At the end of this single-row dryer group 13, the paper web 40 may have a residual moisture content between approximately 2% and approximately 6%, depending on applicable operating conditions and type of subsequently applied coating mixture. The dryer group 13 features an endless felt F, which together with web 40 alternates between drying cylinders 17 and deflection rolls 18. It is conceivable to fashion the deflection rolls 18 as suction rolls with external suction box 19.

After the coater 35 and the noncontact dryers 21, the web 40 traverses again a single-row dryer group 14, which resembles the dryer group 13. Paper guide rolls 22 carry web 40 then to the second coater 35' and thereafter to roll 30' with noncontact dryers 21.

Web 40 undergoes subsequently a further drying in a double-row dryer group 12, such as illustrated in FIG. 1.

FIG. 7, in contrast, shows that the application of the liquid coating mixture on the other side of web 40 can take place right after the noncontact drying that was carried out after the first application by coater 35. The second noncontact drying and the contact drying in dryer group 12 occurs then in the same manner as shown in FIGS. 1, 2 and 3.

It is possible to delete the noncontact dryer 21, which is suitable when only low coating weights need to be applied.

It is understood that web deflection means 30, 30', 39 and 39' illustrated in FIGS. 2 through 4 can each be used in the variants shown in FIGS. 6 and 7.

From all of the figures it is evident that the web needs to traverse in each area only very short unsupported paths, which in addition to the previously described advantages results in improved web runability, especially at high speeds and low web strengths. This results from the risk of web breaks is being reduced considerably.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for treating a traveling web of paper or cardboard in a dryer section, said apparatus comprising:

a first coater positioned after a first dryer group to coat one side of the web, said coater indirectly applying the coating on a first uncoated side of the web, said web having a travel path substantially undeflected immediately following said first coater to a following first web deflector being disposed after said first coater;

a second coater positioned to coat a second uncoated side of the web, said second coater positioned after said first coater and before a second dryer group, said travel path of said web being substantially undeflected immediately following said second coater to a following second web deflector being disposed after said second coater.

2. The apparatus of claim 1 wherein at least one of said deflectors is a drying cylinder configured as a deflector roll.

3. The apparatus of claim 2 wherein said second coater is positioned immediately after said first deflector.

4. The apparatus of claim 2 including noncontact dryers operatively associated with said drying cylinder.

5. The apparatus of claim 4 wherein said second coater is positioned immediately after said first deflector.

6. The apparatus of claim 1 wherein at least one of said web deflectors is a noncontact deflector.

7. The apparatus of claim 1 wherein at least one of said dryer groups is of a double row configuration comprising upper cylinders arranged in an upper row and lower cylinders arranged in a lower row, and wherein at least one of said coaters is disposed in a level between said upper and lower rows.

8. The apparatus of claim 7 wherein said at least one coater is positioned in a level between said upper and lower rows and is arranged directly between said dryer group having a double row configuration and one of said first and second web deflectors positioned in the level of one of said upper and lower rows.

9. The apparatus of claim 7 wherein said at least one coater is arranged directly between a web deflector positioned at the level of one of the upper and lower rows and a web deflector positioned at the level of the other of said upper and lower rows.

10. The apparatus of claim 1 wherein at least one of said dryer groups is of a single row configuration and at least one of said coaters is disposed at about the level of the drying cylinders of said single row group.

11. The apparatus of claim 1 wherein one of said first and second dryer groups comprise noncontact dryers, said deflectors and said noncontact dryers comprising retrofit components in said dryer section, and wherein said deflectors comprise noncontact dryers.

12. The apparatus of claim 11 further comprising first and second cylinders respectively associated with said first and second coaters as backing rolls, said first and second cylinders comprising a pre-existing portion of said dryer section, and said coaters each include an applicator roll that forms a press with one of said first and second cylinders functioning as backing rolls.

13. The apparatus of claim 1 wherein at least one of said coaters is selectively idle whereby said travelling web may be selectively coated on one of said first and second sides.

14. The apparatus of claim 1 wherein said second coater is disposed between an intermediate dryer group and said second dryer group.

* * * * *